US006667450B2

(12) United States Patent
Bulin et al.

(10) Patent No.: US 6,667,450 B2
(45) Date of Patent: Dec. 23, 2003

(54) QUITE BUTTON ASSEMBLY

(75) Inventors: David Stephen Bulin, Greentown, IN (US); Brian Alan Cotterman, Sharpsville, IN (US); Sara J. Baus, Kokomo, IN (US); David J. Clute, Cicero, IN (US); Kamal S. Thakur, Noblesville, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/773,141

(22) Filed: Feb. 1, 2001

(65) Prior Publication Data

US 2002/0100673 A1 Aug. 1, 2002

(51) Int. Cl.[7] ..... H01H 21/08
(52) U.S. Cl. ..... 200/302.3; 200/339
(58) Field of Search ..... 200/302.3, 339

(56) References Cited

U.S. PATENT DOCUMENTS

| | | | | | |
|---|---|---|---|---|---|
| 3,898,397 | A | * | 8/1975 | Devore et al. | 200/302.3 X |
| 4,109,126 | A | * | 8/1978 | Halbeck | 200/302.3 |
| 5,053,591 | A | * | 10/1991 | Theurer | 200/302.3 X |
| 5,752,595 | A | * | 5/1998 | Fein et al. | 200/315 |
| 6,072,135 | A | * | 6/2000 | O'Connor | 200/339 X |
| 6,153,840 | A | * | 11/2000 | Dreher et al. | 200/339 X |

* cited by examiner

*Primary Examiner*—Renee Luebke
(74) *Attorney, Agent, or Firm*—Jimmy L. Funke; Stefan V. Chmielewski

(57) ABSTRACT

A rocker button assembly 10 is provided, including a button body 12 and a pivot element 14. At least one noise reducing element 20 covers a portion of the pivot element 14 and thereby reduces the generation of noise generated by the pivot element 14 as the rocker button assembly 10 rotates.

6 Claims, 1 Drawing Sheet

QUITE BUTTON ASSEMBLY

TECHNICAL FIELD

The present invention relates generally to a button assembly with reduced noise characteristics and more particularly to a button assembly with a reduced tendency to squeak during operation.

BACKGROUND OF THE INVENTION

Electronic devices and controls have become widely prevalent in almost every aspect of life. Their design and purpose can run the gamut of simple operation, audio control, environmental control, and a host of other known uses. Often, the interfaces of these designs use simple controls, such as push buttons, to provide a simple and well known method of activating functions. Commonly, such push buttons are hard plastic injection molded items. Their surfaces may be decorated with words or symbols to indicate function. Although such push buttons may be formed in an almost infinite number of shapes and configurations, one standard category of push button design includes hinged and hard rocker push buttons.

Hinged and hard rocker button designs typically function by pivoting the button body about a pivotal element. Often this is accomplished by positioning the cylindrical pivot element within a pocket allowing the push button to rotate about the cylindrical element. During activation of such designs, however, the rotation of the pivot element within the pocket can generate friction between the pivot element and the pocket and thereby cause noise generation. Often this noise generation takes the form of high pitched noise commonly referred to as squeaking. This noise generation is often highly undesirable. The production of squeaking or squeaks or other undesirable noises during button operation may result in a loss of customer satisfaction. The generation of such noises, although typically not affecting proper operation of the push button, may result in a perception of poor quality. It would, therefore, be highly desirable to have a push button design that would reduce noise generation during operation and thereby improve perceptions of quality and customer satisfaction.

SUMMARY OF THE INVENTION

It is therefore an object of the present invention to provide a rocker button assembly with reduced unwanted noise generation characteristics.

In accordance with the object of the present invention, a rocker button assembly is provided. The rocker button assembly includes a button body, including a pivot element. A noise reducing element covers a portion of the pivot element, thereby reducing the generation of noise due to friction generated by the pivot element during operation.

Other objects and features of the present invention will become apparent when viewed in light of the detailed description of the preferred embodiment when taken in conjunction with the attached drawings and appended claims.

DESCRIPTION OF THE PREFERRED EMBODIMENT(S)

Figure 1:
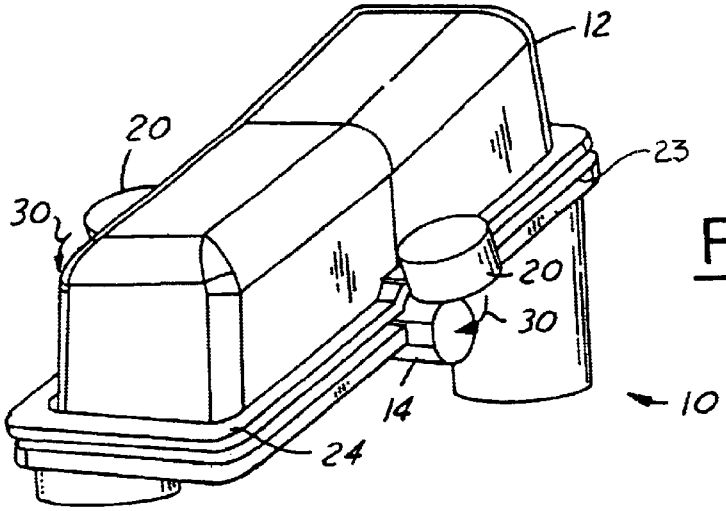
FIG. 1 is an illustration of an embodiment of an unassembled rocker button assembly in accordance with the present invention.

Referring now to FIG. 1, which is an illustration of a rocker button assembly in accordance with the present invention. Rocker button assembly 10 includes button body 12, including pivot element 14. Although rocker button assembly 10 has been illustrated as a traditional rocker-style rocker button, it should be understood that a wide variety of rocker and hinged rocker button shapes and designs are contemplated by the present invention. Both rocker-style and hinged-style rocker buttons utilize a pivot element 14 to allow button movement. In addition, although the pivot element 14 has a general cylindrical shape, it should be understood that a wide variety of pivot element designs are known and used in the prior art and contemplated by this invention.

Figure 2:
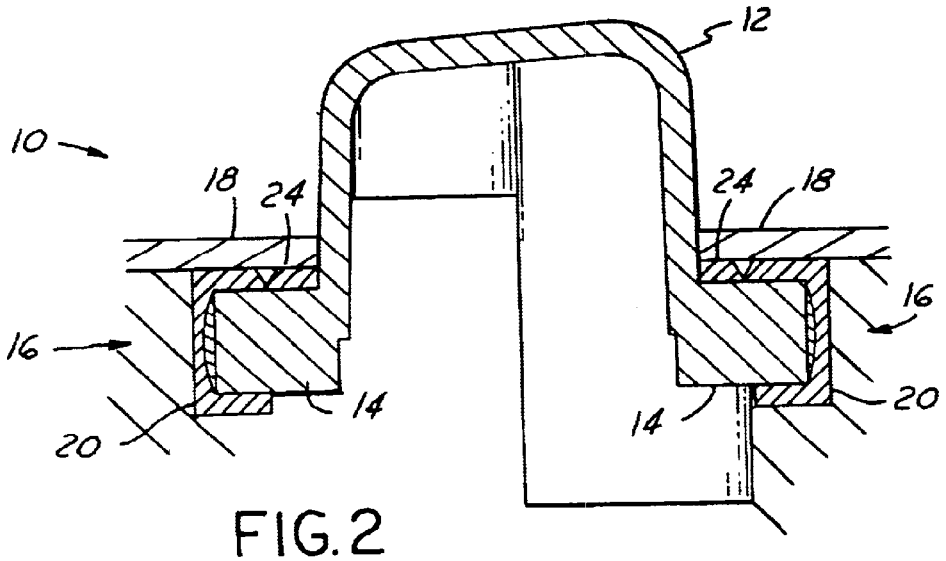
FIG. 2 is a cross-section of an embodiment of a rocker button assembly as shown in FIG. 1, the rocker button assembly shown assembled and mounted for operation.

Referring now to FIG. 2, which is a cross-sectional illustration of a rocker button assembly 10 in accordance with the present invention. The rocker button assembly 10 is commonly mounted such that the pivot element 14 is positioned within a pocket 16. A cap 18 is often positioned over the pocket 16 to hold the rocker button assembly 10 in position against the plurality of walls 15 of the pocket 16. By positioning the pivot element 14 within the pocket 16, the rocker button assembly 10 is allowed to pivot, about a rocker button axis of rotation 17, and thereby affect is operation. Although rocker button assembly 10 has been described with a pivot element 14 residing in a pocket 16, it should be understood that in alternate embodiments, the pocket 16 may be formed as part of the button body 12 and the pivot element 14 may be mounted externally.

The rocker button assembly 10 further includes a noise reducing element 20 covering a portion of the pivot element 14. The noise reducing element 20 is positioned in-between a pivot element 14 and the pocket 16, and thereby reduces the generation of noise caused by friction between the pivot element 14 and the pocket 16 during rotation. Although the noise reducing element 20 may be formed from a variety of materials, in one embodiment the noise reducing element 20 is formed of rubber. In alternate embodiments, the noise reducing element 20 may be formed from a variety of polymers.

Figure 3:
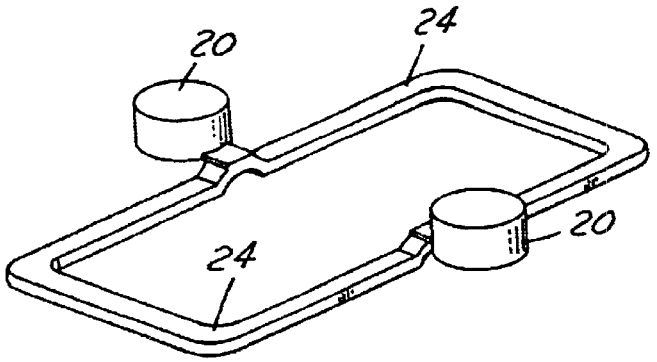
FIG. 3 is a detail of a noise reducing element for use with a rocker button assembly accordance with the present invention.

Often, rocker button designs use back lighting in order to illuminate words or figures illustrated on the surface of the button body 12. With such backlit designs, it may be desirable to prevent the escape of light from around the edges (or perimeter 23) of the rocker button assembly 10. The present invention further contemplates that the noise reducing element 20 may be formed in combination with a gasket 24 to add the further functionality to the button assembly 10 in which the escape of light from around the perimeter 23 of the button assembly 10 is reduced. An illustration of the gasket 24 and noise reducing element(s) 20 is shown in FIG. 3. In the shown embodiment, the noise reducing elements 20 may be folded down (as illustrated by the arrows 30 in FIG. 1) in order to cover a portion of the pivot element 14. One additional advantage of the embodiment illustrated in FIG. 3 is that it may be useful on present rocker button designs and configurations. The ability to use presently manufactured rocker button designs in combination with the noise reducing element 20 in order to practice the present invention, further accentuates the simplicity and versatility of the present invention.

While particular embodiments of the invention have been shown and described, numerous variations and alternative embodiments will occur to those skilled in the art. Accordingly, it is intended that the invention be limited only in terms of the appended claims.

What is claimed is:

1. A rocker button assembly comprising:

a rocker button body having a perimeter, said rocker button body rotatably operable by way of a pivot element formed as a portion of said rocker button body and protruding from said perimeter along a rocker button axis of rotation, said pivot element rotatably secured within a pocket by a plurality of walls of said pocket; and at least one noise reducing element positioned between said pivot element and said pocket, said at least one noise reducing element isolating said pivot element from contact with said pocket such that noise generated by the friction of rotation of said pivot element within said pocket is reduced.

2. The rocker button assembly as described in claim 1 further comprising:

a gasket running along said perimeter of said rocker button body.

3. The rocker button assembly as described in claim 2 wherein said gasket and said noise reducing element are formed as a single element.

4. The rocker button assembly as described in claim 1 wherein said at least one noise reducing element is a polymer.

5. A rocker button assembly as described in claim 1 wherein said at least one noise reducing element is comprised of rubber.

6. A rocker button assembly as described in claim 1 wherein said pivot element is a cylinder.

* * * * *